US006347494B1

(12) United States Patent
Noirot

(10) Patent No.: US 6,347,494 B1
(45) Date of Patent: Feb. 19, 2002

(54) WOOD FILLED PLASTIC BUILDING MEMBERS AND METHOD OF MANUFACTURE

(75) Inventor: Nicholas N. Noirot, Erie, PA (US)

(73) Assignee: CW Ohio, Inc., Conneaut, OH (US)

( * ) Notice: Subject to any disclaimer, the term of this patent is extended or adjusted under 35 U.S.C. 154(b) by 0 days.

(21) Appl. No.: 09/266,985

(22) Filed: Mar. 12, 1999

(51) Int. Cl.[7] ..... E04C 1/00

(52) U.S. Cl. ..... 52/309.4; 52/309.8; 52/181; 52/483.1; 52/738.1

(58) Field of Search ..... 52/309.4, 309.8, 52/309.9, 309.13, 309.14, 483.1, 181, 738.1

(56) References Cited

U.S. PATENT DOCUMENTS 4,158,275 A * 6/1979 Moore ..... 52/210
5,625,999 A * 5/1997 Buzza ..... 52/309.9
5,653,075 A * 8/1997 Williamson ..... 52/309.9
5,660,016 A * 8/1997 Erwin ..... 52/483.1
6,006,480 A * 12/1999 Rook ..... 52/309.12
6,047,514 A * 4/2000 Verch ..... 52/309.9
6,231,994 B1 * 5/2001 Totten ..... 428/537.1

OTHER PUBLICATIONS

Forest Products Laboratory General Technical Report FPL–GTR–91 entitled Waste–Wood–Derived Fillers for Plastics, 1996—17 pages.

North Wood Plastics, Inc. cover sheet and literature relating to wood filled plastics, undated (admitted prior art)—21 pages.

Natural Fiber Composites, Inc. letter and literature relating to wood and paper filled plastics, Feb. 11, 1997—5 pages.

* cited by examiner

*Primary Examiner*—Beth A. Stephan
(74) *Attorney, Agent, or Firm*—Renner, Otto, Boisselle & Sklar, LLP

(57) ABSTRACT

An exterior building member includes an outer shell that is extruded slightly oversize out of a plastic compound such as polystyrene containing wood fill. The shell is filled with a rigid plastic foam such as rigid high density, low pressure polyurethane foam, after which material is removed from the exterior profile of the shell to bring the exterior profile to within a desired dimensional tolerance.

6 Claims, 1 Drawing Sheet

WOOD FILLED PLASTIC BUILDING MEMBERS AND METHOD OF MANUFACTURE

FIELD OF THE INVENTION

This invention relates generally to wood filled plastic building members especially for use as a wood replacement in exterior structural applications and to the method of making such members.

BACKGROUND OF THE INVENTION

Wood is widely used for structural members in both interior and exterior building applications. One of the objections to using wood for exterior applications is its high maintenance cost. Also, if not properly maintained and left exposed to harsh environments, wood will eventually rot or decay and have to be replaced.

It is generally known to make rot resistant window and door components and other structural members out of wood filled plastic compounds. Also, it is generally known that such wood filled plastic compounds can be extruded. However, hollow wood filled plastic extrusions are not very stiff and do not have good fastener hold strength, making them unsuitable for many structural member applications.

SUMMARY OF THE INVENTION

The present invention provides a cost effective way of commercially producing rigid wood filled plastic building members having good fastener holding capabilities.

In accordance with one aspect of the invention, a hollow elongated member of the desired general size and external shape or profile is extruded out of a suitable wood filled plastic compound and subsequently filled with a rigid plastic foam material.

In accordance with another aspect of the invention, during the extrusion process, the exterior profile of the member is intentionally extruded oversize and subsequently finished to the desired tolerance after the extruded member has been filled with rigid plastic foam.

In accordance with another aspect of the invention, the wood filled thermoplastic compound from which the member is extruded is comprised of between 50 to 80% thermoplastic and 50 to 20% wood fill with approximately 65% polystyrene and 35% wood flour being preferred.

In accordance with another aspect of the invention, the foam material used to fill the extruded wood filled plastic member is preferably a rigid high density, low pressure polyurethane foam.

In accordance with another aspect of the invention, after the hollow extruded member is filled with rigid plastic foam and finished to the desired tolerance, a prime coat of acrylic latex based paint is preferably applied to the exterior profile of the member.

These and other aspects, objects, advantages and features of the present invention will become apparent as the following description proceeds.

To the accomplishment of the foregoing and related ends, the invention, then, comprises the features hereinafter fully described and particularly pointed out in the claims, the following description and the annexed drawing setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
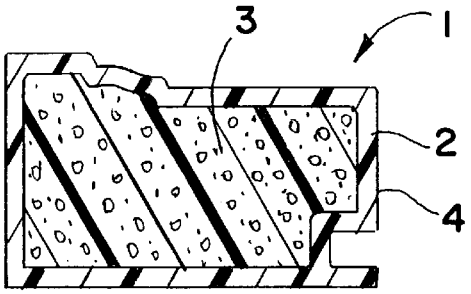
FIG. 1 is a transverse section through a preferred form of wood filled plastic building member made in accordance with this invention, which may be of any desired size and external profile.

Durable rot resistant wood filled plastic building members of any desired size and exterior shape or profile may be made in accordance with the present invention to replace most exterior structural millwork components and other building members including window components such as brickmould, sill, sill nose, blind stop, mullion casing, sash-rail, sash-check rail and sash-stile as well as door components such as door jambs and the like. FIG. 1 shows one such building member or component 1, in this case a brickmould.

Regardless of the size and external shape or profile of building member being made, the member 1 includes an elongated hollow outer shell 2 extruded out of a suitable wood filled plastic compound. One such compound that has been found to be particularly effective in making the outer shell 2 of the member 1 is comprised of between 50 to 80% thermoplastic and 50 to 20% wood fill with approximately 65% high impact polystyrene and 35% wood flour being preferred. High impact polystyrene is a relatively low cost thermoplastic that has a high flexure modulus and good paintability. However, it should be understood that compounds of other thermoplastics containing other wood fillers including reground wood fiber could also be used to make the outer shell if desired.

The outer shell 2 is completely filled with a rigid plastic foam material 3 preferably rigid high density, low pressure polyurethane foam. Applied to the exterior surface of the outer shell 2 is a prime coat 4 preferably of acrylic latex based paint.

Figure 2:
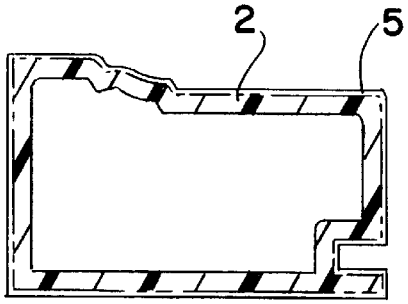
FIG.2 is a transverse section through the extruded outer shell of the member before the shell has been filled with rigid plastic foam and the exterior profile has been machine finished to the desired tolerance.

Initially during the manufacturing process, the outer shell 2 is extruded and drawn down to the desired general size and external profile but is intentionally made slightly oversize so that it has a dimensional tolerance 5 somewhat greater than desired as schematically shown in FIG. 2, for example a tolerance of approximately +0.025 inch. Wood filled polystyrene is net size extrudable, but expands during the extrusion process, making it difficult to hold the outer profile dimensions of the shell 2 to a tolerance of less than +0.025 inch.

Figure 3:
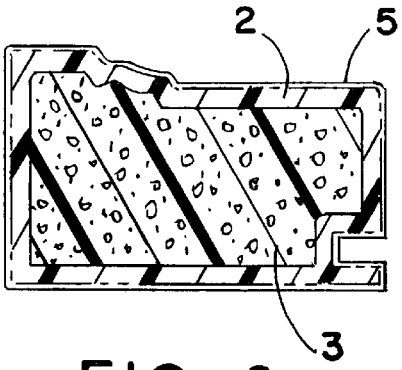
FIG. 3 is a transverse section through the extruded outer shell of the member after the shell has been filled with rigid plastic foam but before the exterior profile has been machine finished to the desired tolerance.

After the extrusion process has been completed, the outer shell 2 is filled with a rigid plastic foam material 3 such as rigid high density, low pressure polyurethane foam as shown in FIG. 3 to give the outer shell the desired support necessary in order to be able to mold (i.e., machine finish) the external profile of the member 1 (FIG. 1) to the final desired tolerance, for example, ±0.005 inch, using a wood molder or the like. A wood molder is a machine that has multiple shaper heads used to remove for example approximately 0.020 inch of the shell material around the entire external profile of the extruded part. Close tolerances such as these are needed when making many building members, for example, window sills that require flat surfaces to meet certification limits for water leakage. Also, many building members must be sufficiently rigid to meet certain load requirements including for example certification limits for wind loading of window components and the like.

Another advantage in filling the outer shell 2 with a rigid foam material 3 such as rigid high density, low pressure polyurethane foam is that the finished member 1 can be used as a wood substitute without having to change the type of fasteners used to attach the member to other members. Hollow wood filled plastic extrusions generally don't have good hold strength for fasteners such as nails or screws. However, the hold strength of nails and/or screws to rigid high density, low pressure plastic foam is quite high.

Figure 4:
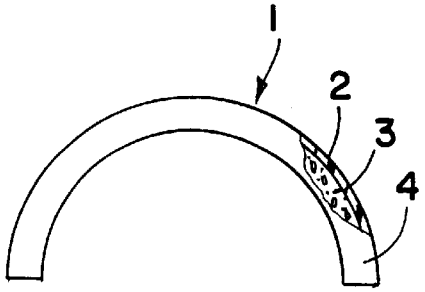
FIG. 4 is a reduced plan view, partly in section, showing a length of wood filled plastic building member made in accordance with this invention bent to a half round.

Making the outer shell 2 of member 1 out of a wood filled thermoplastic such as polystyrene has the further advantage that the finished member can be bent when heated to form for example a half round for windows or the like as schematically shown in FIG. 4. The extra support of the extruded wood filled polystyrene shell 2 holds the polyurethane foam 3 together and allows the member to be bent into a half round (or other shape) even though the polyurethane foam is a thermoset.

After the external profile of the shell 2 has been molded/machine finished to the desired size tolerance, a prime coat 4 of acrylic latex based paint is applied to the exterior of the shell. The reason a prime coat of acrylic latex based paint is applied is that it will stick to the polystyrene, thus allowing a final coat of paint, stain or other surface coating to be easily applied to the member as desired. Finally, the ends of the member may be worked (i.e., mitered or beveled) if desired.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. An exterior building member comprising a hollow extruded elongated outer shell made of a thermoplastic compound containing wood fill and a rigid foam plastic core, said shell having an external profile that is extruded oversize and machine finished to a final desired dimensional tolerance.

2. The building member of claim 1 wherein the exterior profile of said shell is extruded to a dimensional tolerance of approximately +0.025 inch and machine finished to a final dimensional tolerance of approximately ±0.005 inch.

3. The building member of claim 1 wherein the exterior profile of said shell has machine finished flat surfaces that meet specified certification limits for water leakage.

4. The building member of claim 3 wherein said flat surfaces have final dimensional tolerances of ±0.005 inch.

5. The building member of claim 1 wherein said thermoplastic is polystyrene.

6. The building member of claim 1 wherein said shell has an exterior prime coat of acrylic latex based paint.

* * * * *